United States Patent [19]

Suzuki et al.

[11] Patent Number: 5,050,564

[45] Date of Patent: Sep. 24, 1991

[54] FUEL INJECTION CONTROL SYSTEM FOR AN ENGINE OF A MOTOR VEHICLE PROVIDED WITH A CONTINUOUSLY VARIABLE BELT-DRIVE

[75] Inventors: Kazuo Suzuki; Fusao Tachibana; Shinichi Kurosu, all of Saitama; Mitsugi Chonan, Ibaragi, all of Japan

[73] Assignees: Fuji Jukogyo Kabushiki Kaisha, Tokyo, Japan; Polaris Industries L.P., Minneapolis, Minn.

[21] Appl. No.: 602,579

[22] Filed: Oct. 24, 1990

[51] Int. Cl.[5] ..... F02D 41/10

[52] U.S. Cl. ..... 123/492

[58] Field of Search ..... 123/492, 493; 74/866; 364/424.1, 431.07

[56] References Cited

U.S. PATENT DOCUMENTS 4,721,083 1/1988 Hasaka ..... 123/493
4,884,548 12/1989 Sogawa ..... 123/492

FOREIGN PATENT DOCUMENTS 57-116138 7/1982 Japan .
58-169117 11/1983 Japan .
63-29039 2/1988 Japan .
63-255543 10/1988 Japan .

*Primary Examiner*—Tony M. Argenbright
*Attorney, Agent, or Firm*—Martin A. Farber

[57] ABSTRACT

A motor vehicle has a continuously variable belt-drive transmission having a clutch means which engages when speed of an engine is higher than a clutch engaging speed. A plurality of basic pulse widths for injecting fuel are stored in a memory arranged in accordance with the engine speed and opening degree of a throttle valve. Some of the basic pulse widths in a speed range lower than the clutch engaging engine speed are increased for acceleration of the engine. One of the basic pulse widths is retrieved in accordance with the actual engine speed and the throttle valve opening degree, and a fuel injection pulse width is calculated based on the retrieved basic pulse width.

2 Claims, 7 Drawing Sheets

FUEL INJECTION CONTROL SYSTEM FOR AN ENGINE OF A MOTOR VEHICLE PROVIDED WITH A CONTINUOUSLY VARIABLE BELT-DRIVE

BACKGROUND OF THE INVENTION

The present invention relates to a fuel injection control system for an engine of a motor vehicle having a continuously variable belt-drive transmission, and more particularly to a fuel injection system where a basic fuel injection pulse width is drived from a look-up table.

In recent years, it has been proposed that a two-cycle engine is provided with an electronically controlled fuel injector.

Japanese Utility Model Application Laid-Open 58-169117 discloses a fuel injection control system where the quantity of fuel to be injected is determined in accordance with an intake air quantity detected by an air flow meter and engine speed. In a system disclosed in Japanese Patent Application Laid-Open 63-255543, the fuel injection quantity is determined in accordance with an intake air pressure detected by a pressure sensor provided downstream of a throttle valve, and the engine speed.

Japanese Patent Application Laid-Open 63-29039 discloses a fuel injection control system where the intake air quantity is estimated based on a throttle valve opening degree detected by a throttle position sensor, and engine speed. Such a fuel injection system is relatively widely used for the engine, because the air-flow meter and the pressure sensor can be obviated. Thus, the system can be simplified and the manufacturing cost reduced. However, it is necessary to increase the basic quantity of the injected fuel when the throttle valve is rapidly opened for acceleration.

Japanese Patent Application Laid-Open 57-116138 discloses a fuel injection system wherein, whether the engine is in a steady state or a transient state is determined in dependency on a throttle valve opening speed. In the steady state, a basic fuel injection pulse width is retrieved from a look-up table storing a plurality of basic injection pulse width in accordance with the intake pressure and engine speed. When the transient state is determined, the basic fuel injection pulse width is retrieved from another look-up table storing a plurality of pulse widths, arranged in accordance with the throttle opening degree and engine speed.

However, in order to provide two tables, a memory having a large capacity must be provided. In addition, a computing process for determining the condition of the engine is complicated, resulting in increase of the capacity of the microcomputer.

Moreover, a problem occurs when the fuel injection system is applied to an engine of a motor vehicle having a continuously variable belt-drive transmission where the transmission ratio is continuously changed in accordance with engine speed and engine load. More particularly, the continuously variable transmission is connected with the crankshaft of the engine when the engine speed becomes higher than a certain speed which is substantially constant. On the other hand, in the transient state such as rapid starting of the vehicle, the throttle valve is quickly opened. However, the speed of the engine does not quickly increase. Therefore, the pulse width derived from the look-up table in accordance with the throttle opening degree and the engine speed is not wide enough to rapidly start the vehicle. In other words, the vehicle can not be rapidly accelerated.

SUMMARY OF THE INVENTION

An object of the present invention is to provide a fuel injection control system wherein the computing process may be simplified and the capacity of the microcomputer may be reduced.

Another object of the present invention is to provide a fuel injection control system which may be applied to a vehicle having a continuously variable belt-drive transmission so as to provide a sufficient accelerating characteristics at the start of the vehicle.

According to the present invention there is provided a fuel injection control system for an engine of a motor vehicle with a continuously variable belt-drive transmission having clutch means which engages when speed of the engine is higher than a clutch engaging speed.

The system comprises first detector means for detecting the speed of the engine, second detector means for detecting opening degree of a throttle valve of the engine, a memory storing a plurality of basic pulse widths for injecting fuel, which are arranged in accordance with the engine speed and the throttle valve opening degree, some of the basic pulse widths in a speed range lower than the clutch engaging engine speed being increased for acceleration of the engine, retrieving means for retrieving one of the basic pulse widths in accordance with the detected engine speed and the throttle valve opening degree, calculator means for calculating a fuel injection pulse width based on the retrieved basic pulse width.

In an aspect of the invention, the increased basic pulse widths are provided to increase as the engine speed and the throttle opening degree increase.

The other objects and features of this invention will become understood from the following description with reference to the accompanying drawings.

DETAILED DESCRIPTION OF THE PREFERRED EMBODIMENTS

Figure 1A:
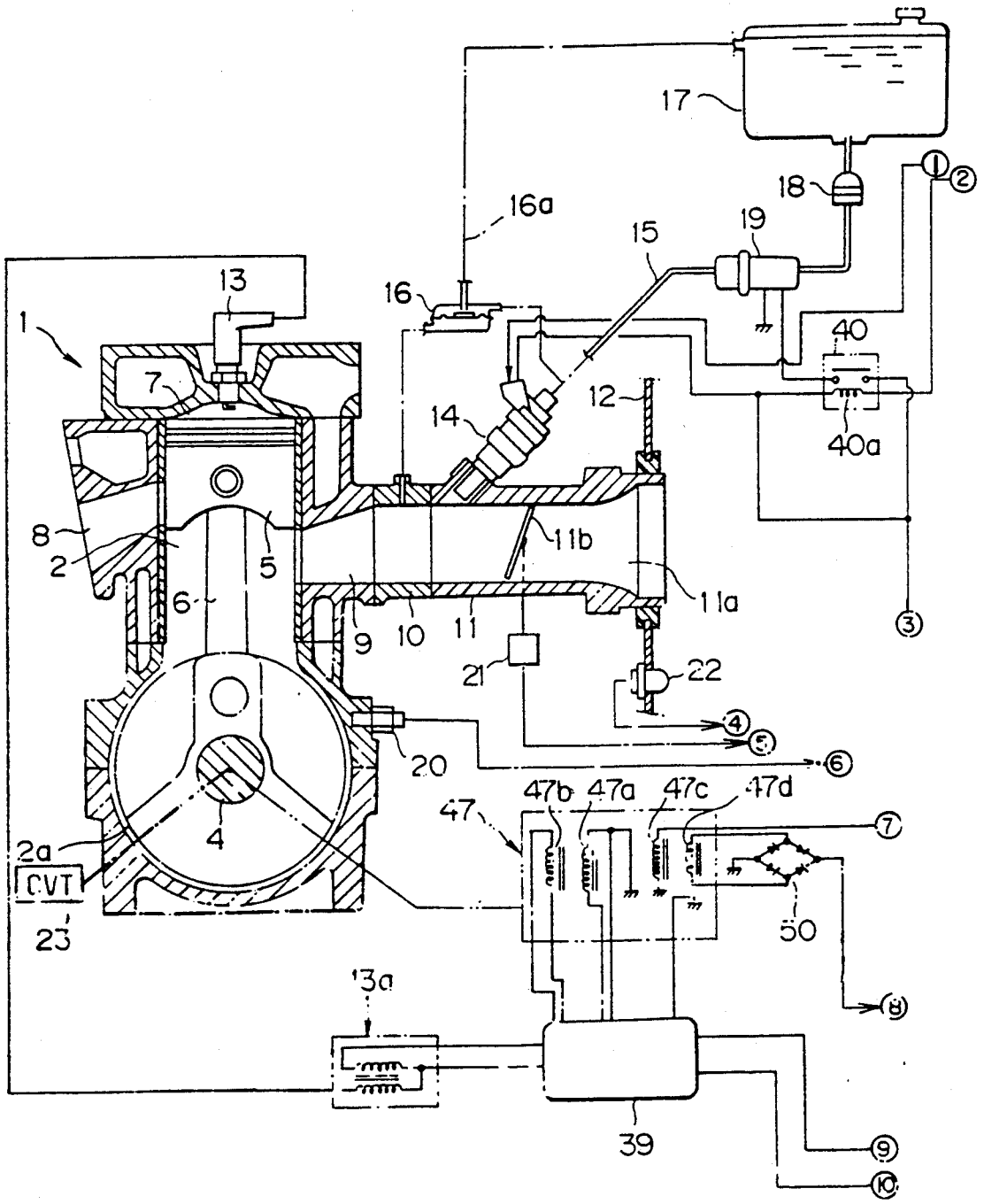
FIGS. 1*a* to 1*c* are schematic diagrams showing a control system for an engine including a circuit of the present invention.
Figure 1B:
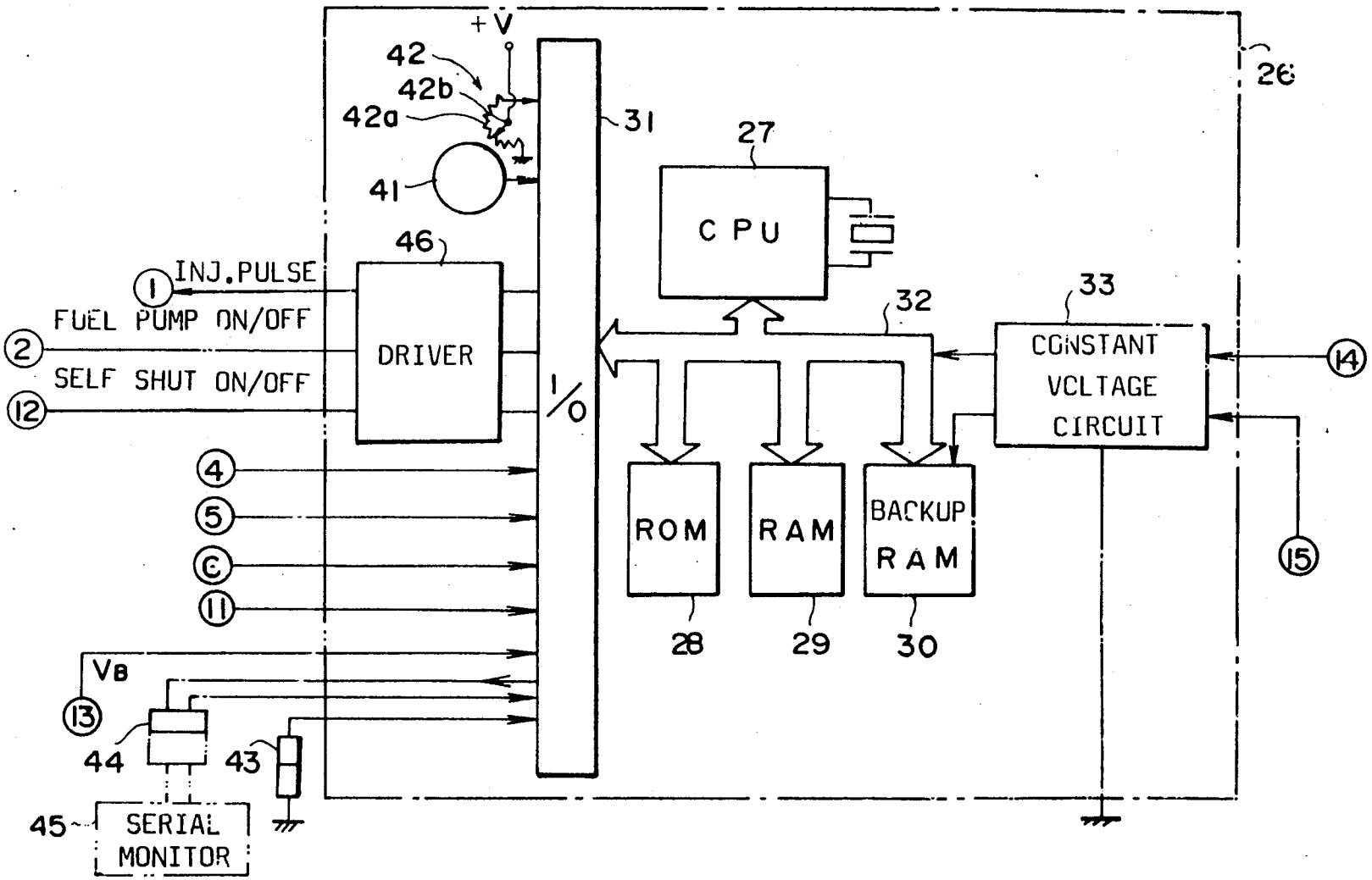
Figure 1C:
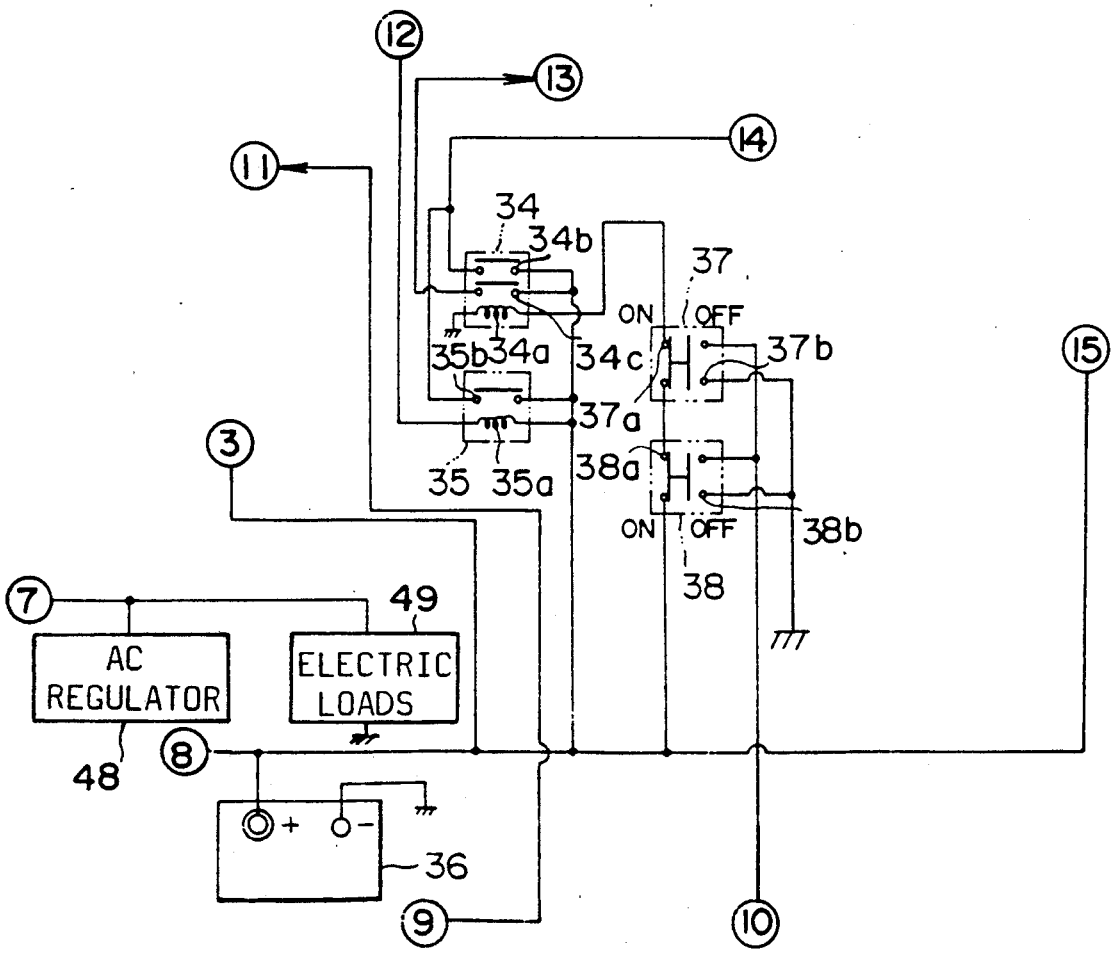

Referring to FIGS. 1*a* to 1*c*, a two-cycle engine 1 for a motor vehicle such as a snowmobile comprises a cylinder 2, a piston 5 provided in the cylinder 2 and defining a combustion chamber 7 therein, a connecting rod 6 connected with the piston 5 and a crankshaft 4 disposed in a crankcase 2*a*. The combustion chamber 7 is communicated with the crankcase 2*a*, where the intake air is preliminary compressed, through a transfer port (not shown) formed in a wall of the cylinder 2. A spark plug 13 is provided on a top of the combustion chamber 7. In a wall of the cylinder 2, an exhaust port 8 and an intake port 9 as a part of an intake passage are formed opposing one another. The exhaust port 8 and the transfer port are adapted to open at a predetermined timing with respect to the position of the piston 5. The intake port 9 has a reed valve (not shown) or a rotary valve (not shown) operatively connected to the (not shown) operatively connected to the crankshaft 4 so as to induce air to the cylinder 2 at a predetermined timing.

Air is induced in the cylinder 2 passing through an intake system. The intake system comprises an air box 12 housing an air cleaner, a throttle body 11 having a throttle valve 11*b* and connected to the air cleaner through an air horn 11*a*, and an insulator 10 connecting the throttle body 11 to the intake port 9. Exhaust gas of the engine 1 is discharged passing through the exhaust port 8. A fuel injector 14 is provided in the throttle body 11 downstream of the throttle valve 11*b*.

Fuel in a fuel tank 17 is supplied to the injector 14 through a fuel passage 15 having a filter 18 and a pump 19.

The fuel injector 14 is communicated with a fuel chamber of a pressure regulator 16 and the fuel tank 17 is communicated with an outlet of the fuel chamber through a return passage 16*a*. A pressure regulating chamber is communicated with the throttle body 11.

The fuel in the tank 17 is supplied to the fuel injector 14 and the pressure regulator 16 by the pump 19 through the filter 18. The difference between the inner pressure of the throttle body 11 downstream of the throttle valve 11*b* and the fuel pressure applied to the injector 14 is maintained at a predetermined value by the pressure regulator 16 so as to prevent the fuel injection quantity of the injector 14 from changing.

A crankcase temperature sensor 20 is provided on a crankcase 2*a*. A throttle position sensor 21 is attached to the throttle body 11, and an intake air temperature sensor 22 is mounted on the air box 12.

Figure 2:
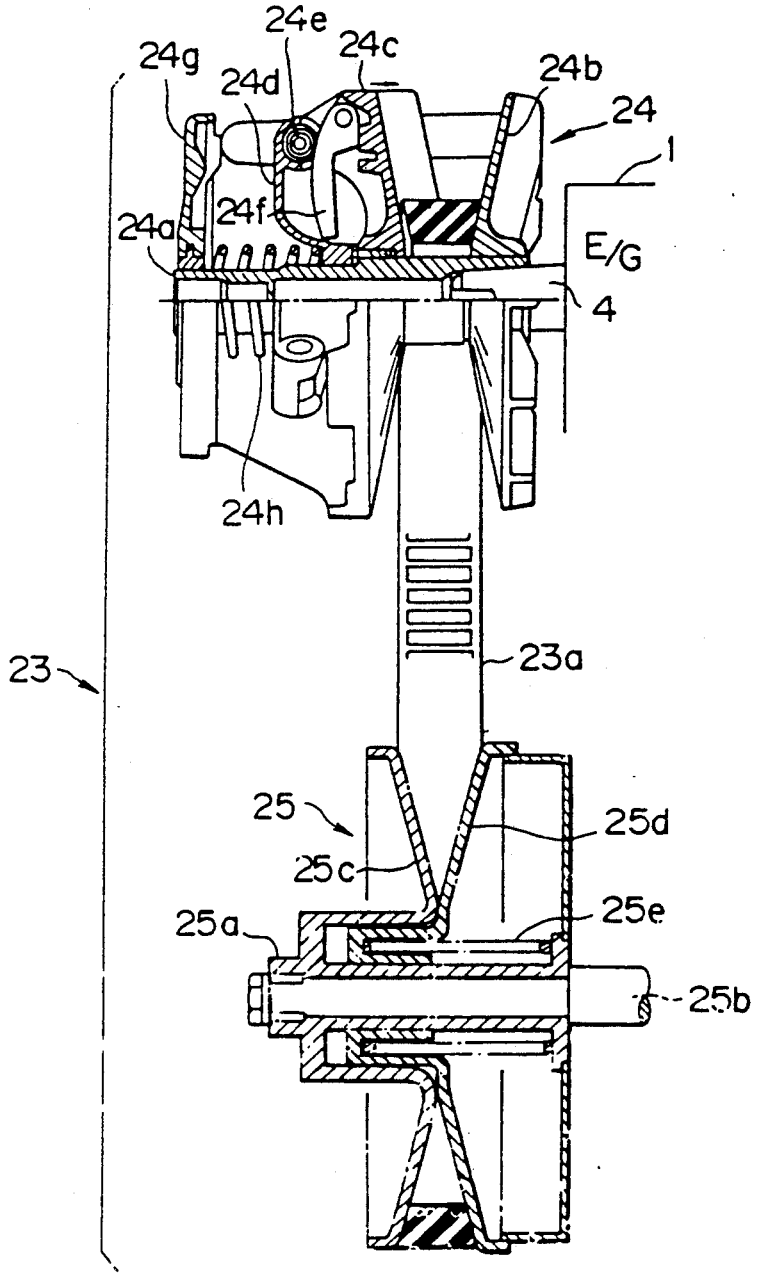
FIGS. 2 is a sectional view of a continuously variable transmission connected to the engine.

The engine 1 is connected to a well-known continuously variable belt-drive transmission (CVT) 23 shown in FIG. 2. The belt-drive transmission 23 has an input shaft 24*a* connected to the crankshaft 4 of the engine 1 and an output shaft 25*a* provided in parallel with the input shaft 24*a*. A drive pulley (primary pulley) 24 and a driven pulley (secondary pulley) 25 are mounted on shafts 24*a* and 25*b* respectively. A drive V-belt 23*a* engages with the drive pulley 24 and the driven pulley 25.

A fixed conical disc 24*b* of the drive pulley 24 is integral with the input shaft 24*a* and an axially movable conical disc 24*c* is axially slidably splined on the input shaft 24*a*. A centrifugal weight 24*f* is pivotally mounted on the back of the movable conical disc 24*c*. The centrifugal 24*f* abuts on a roller 24*e* of a slider 24*d* which is slidably splined on the input shaft 24*a*. The intake shaft 24*a* has spring retainer 24*g* secured to the end-most portion. A return spring 24*h* is provided between the spring retainer 24*g* and the slider 24*d* to urge the slider 24*d* toward the movable disc 24*c*.

A fixed conical disc 25*c* of the driven pulley 25 is formed on the output shaft 25*a* opposite a movable conical disc 25*d*. The conical disc 25*d* has a boss in which a return spring 25*e* is disposed to urge the movable disc 25*d* toward the fixed disc 25*c*. The output shaft 25*b* is connected to crawler (not shown) provided on a rear portion of the snowmobile through a one-way clutch (not shown) which prevents the shaft 25*b* from rotating in the reverse direction.

When the engine speed is lower than a clutch engaging speed (clutch meet line is, 3000 rpm to 4000 rpm for example), a small centrifugal force is exerted on the centrifugal weight 24*f*. Thus, the spring force is small and hence the disc 24*c* disengages from the drive belt 23*a* so that the belt slips on the discs 24*b* and 24*c*. Consequently, the power transmission to the driven pulley 25 is cut.

Referring to FIG. 1*b*, an electronic control unit (ECU) 26 having a microcomputer comprises a CPU (central processing unit) 27, a ROM 28, a RAM 29, a backup RAM 30 and an input/output interface 31, which are connected to each other through a bus line 32. A predetermined voltage is supplied from a constant voltage circuit 33. The constant voltage circuit 33 is connected to a battery 36 through a contact 34*b* of an ECU relay 34 and a contact 35*b* of a self-shut relay 35 which are parallely connected with each other. Furthermore, the battery 36 is directly connected to the constant voltage circuit 33 so that the backup RAM 30 is backed up by the battery 36 so as to maintain the stored data even if a key switch (not shown) is in off-state. Sensors 20, 21 and 22 are connected to input ports of the input/output interface 31. An atmospheric pressure sensor 41 is provided in the control unit 26 and connected to an input port of the input/output interface 31. Output ports of the interface 31 are connected to a driver 46 which is connected to injectors 14 and a coil 40*a* of a relay 40 for the pump 19.

The ECU relay 34 has a pair of contacts 34*b* and 34*c* and an electromagnetic coil 34*a*. As hereinbefore described, the contact 34*b* is connected to the constant voltage circuit 33 and the battery 36. The other contact 34*c* is connected to the input port of the I/O interface 31 and the battery 36 for monitoring the voltage VB of the battery 36. The coil 34*a* of the relay 34 is connected to the battery 36 through ON-terminals 37*a*, 38*a* of a kill switch 37 and an ignition switch 38.

The kill switch 37 is provided on a grip (not shown) of the snowmobile to stop the snowmobile.

ON-terminals 38*a* and 37*a* of the ignition switch 38 and the kill switch 37 are connected to each other in series and OFF-terminals 38*b* and 37*b* of switches 38 and 37 are connected to each other in parallel. When both the switches 37 and 38 are turned on, power from the battery 36 is supplied to the coil 34*a* of the relay 34 to excite the coil to close each contact. Thus, the power from the battery 36 is supplied to the constant voltage circuit 33 through the contact 34*b* for controlling the control unit 26.

The self-shut relay 35 has the contact 35*b* connected to the constant voltage circuit 33 and the battery 36 and a coil 35*a* connected to the output port of the I/0 interface 31 through the driver 46 and the battery 36.

When one of the switches 37 and 38 is turned off, the engine stops. After the stop of the engine, the power from the battery 36 is supplied to the coil 35*a* of the self-shut relay 35 for a predetermined period (for example, ten minutes) by the operation of the control unit, thereby supplying the power to the control unit 26 for the period.

When the engine is restarted while the engine is warm within the period, the quantity of fuel injected from the injector 14 is corrected to a proper value, so that the restart of the engine in hot engine condition is ensured.

The battery 36 is further connected to the coil 40*a* of the fuel pump relay 40 and to the injector 14 and the pump 19 through a contact of the relay 40.

Furthermore, a capacitor discharge ignition (CDI) unit 39 is provided as an ignition device. The CDI unit 39 is connected to a primary coil of an ignition coil 13*a* and to the spark plug 13 through a secondary coil. A signal line of the CDI unit 39 is connected to the input port of the I/0 interface 31 of the control unit 26 for applying CDI pulses. When one of the switches 37 and 38 is turned off, lines for the CDI unit are short-circuited to stop the ignition operation.

A magneto 47 for generating alternating current is connected to the crankshaft 4 of the engine 1 to be operated by the engine. The magneto 47 has an exciter coil 47*b*, a pulser coil 47*a*, a source coil 47*c*, and a charge coil 47*d*. The pulser coil 47*a* is connected to the CDI unit 39. The source coil 47*c* is connected an AC regulator 48, so that the voltage is regulated, and the regulated voltage is applied to an electric load 49 such as lamps, a heater and various accessories of the vehicle. Namely, the regulated output of the magneto is independently supplied to the electric load 49. The charge coil 47*d* is connected to the battery 36 through a rectifier 50.

The power from the battery 36 is supplied to the electric loads of the electronic control system such as the injector 14, pump 19, control unit 26, coils 34*a*, 35*a* and 40*a* of relays 34, 35 and 40. During engine operation, the alternating current from the charge coil 47*d* is rectified by the rectifier 50 to charge the battery 36.

The CPU 27 calculates engine speed N from a duration of pulses of the CDI pulse signals from the CDI unit 39 in accordance with the control programs stored in the ROM 28. Based on engine speed N and throttle valve opening degree $\alpha$ from the throttle position sensor 21, a basic fuel injection pulse width Tp is calculated.

The basic fuel injection pulse width Tp is corrected with various data stored in the RAM 29 so that an actual fuel injection pulse width Ti is calculated. The I/0 interface 31 produces a driving signal of the pulse width Ti as a trigger signal of the CDI pulse signal which is applied to the fuel injector 14 through the driver 46.

As a self-diagnosis function of the system, a connector 43 for changing a diagnosis mode and a connector 44 for diagnosing the engine are connected to the input ports of the I/0 interface 31. A serial monitor 45 is connected to the control unit 26 through the connector 44. The trouble mode changing connector 43 operates to change the self-diagnosis function of the control unit 26 into either a U(user)-check mode or D(dealer)-check mode. In normal state, the connector 43 is set in the U-check mode. When an abnormality occurs in the system during the driving of the vehicle, trouble data are stored and kept in the backup RAM 30. At a dealer's shop, the serial monitor 45 is connected through the connector 44 to read the data stored in the RAM 29 for diagnosing the trouble of the system. The connector 43 is changed to the D-check mode to diagnose the trouble more in detail.

The ECU 26 further has an idle speed adjuster 42. The idle speed adjuster 42 is, for example, a potentiometer having a resistor 42*a* one end of which is connected to the I/O interface 31, and a movable contact 42*b* connected to a constant voltage source +V. The movable contact 42*b* is manually operated to change the output terminal voltage VMR which is a factor for adjusting a fuel injection pulse width at idling.

Figure 3:
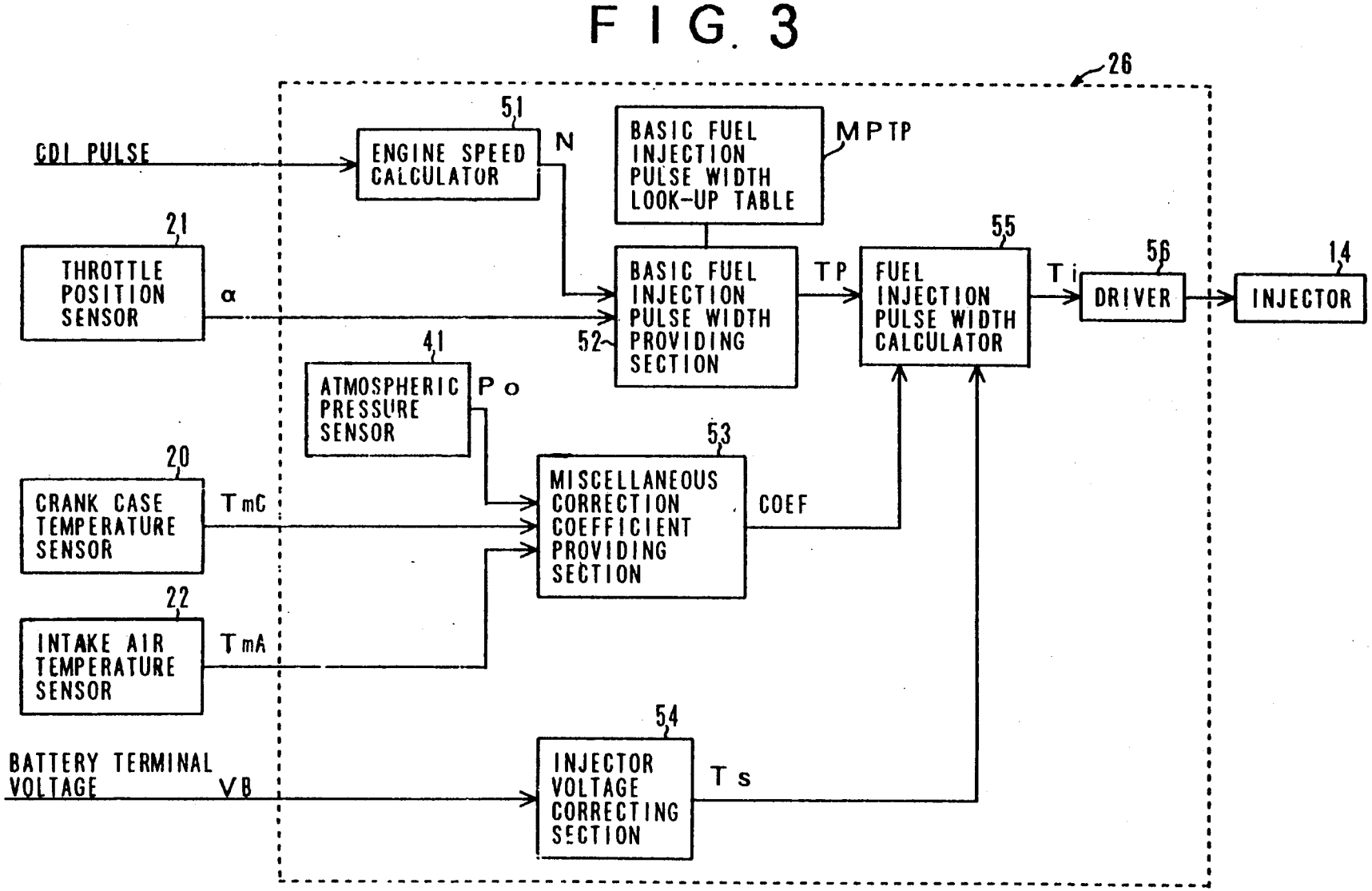
FIG. 3 is a block diagram of a control unit of the present invention.

Referring to FIG. 3, the ECU 26 has an engine speed calculator 51 to which the CDI pulse signals from the CDI unit 39 is fed to calculate the engine speed N. That is, if the engine 1 is a three-cylinder engine for example, the CDI pulse is generated once every 120° CA. A cycle f is obtained from a time interval 120° between each CDI pulse in accordance with, $$f = dt120^\circ / d\theta 120^\circ$$

The engine speed N is calculated based on the cycle f as follows:

$$N = 60/(2\pi \cdot f)$$

Figure 4:
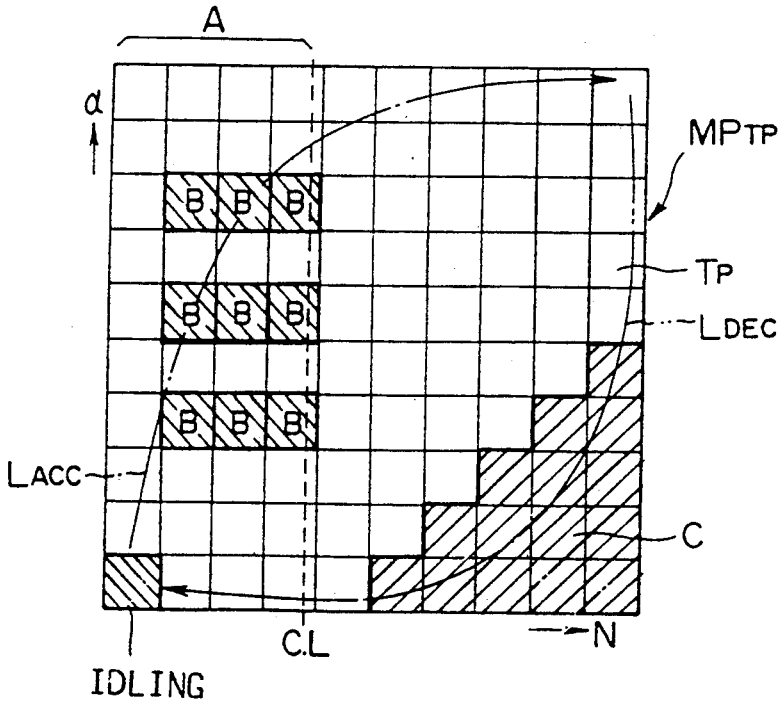
FIG. 4 is an illustration conceptually showing a basic fuel injection pulse width according to the present invention.

The engine speed N calculated in the calculator 51 and the throttle opening degree $\alpha$ detected by the throttle position sensor 21 are applied to a basic fuel injection pulse width providing section 52. The basic fuel injection pulse width providing section 52 retrieves a basic fuel injection pulse width Tp from a three-dimensional basic fuel injection pulse width loop-up table MPTP having a plurality of lattices each storing a basic fuel injection pulse width Tp in accordance with the engine speed N and the throttle opening degree as shown in FIG. 4.

More particularly, a quantity Q of the intake air passing through the throttle valve 11*b* is a function of the engine speed N and the throttle opening degree $\alpha$. On the other hand, the basic fuel injection pulse width Tp can be calculated in accordance with $$Tp = K \cdot Q/N. \text{ (}K\text{ is a constant)}$$

Hence, the basic fuel injection pulse width Tp are obtained through experiments and stored in the look-up table MPTP in accordance with engine speed N and throttle opening degree $\alpha$ as parameters. The basic fuel injection pulse widths may be calculated by interpolation based on the pulse widths retrieved from the table MPTP.

In accordance with the present invention, the basic fuel injection pulse widths Tp stored in the table MPTP are corrected beforehand to comply with the various engine operating conditions. Referring to FIG. 4, a clutch engaging speed line CL at which the drive belt 23*a* is gripped by the discs 24*b* and 24*c* of the drive pulley 24 to transmit the engine output, is substantially constant, for example, in a range of 3000 rpm to 4000 rpm. The engine speed range lower than the clutch engaging speed line CL is a nonload zone A. In order to increase the quantity of fuel at the startling acceleration, the basic fuel injection pulse widths Tp stored in some of the lattices B in the zone A are increased, for example, at the hatched lattices in FIG. 4. The increased of the basic pulse width Tp gradually increases with increase of the throttle openings degree $\alpha$ and engine speed N.

On the other hand, in the engine speed range higher than the clutch engaging speed line CL, the basic fuel injection pulse widths Tp are set at zero in a rapid deceleration zone C.

The ECU 26 has a miscellaneous correction coefficient providing section 53 for correcting the air-fuel ratio. A miscellaneous correction coefficient COEF is calculated in dependency on an atmospheric pressure Po from the atmospheric pressure sensor 41, a crankcase temperature TmC from the crankcase temperature sensor 20 and an intake air temperature TmA from the intake air temperature sensor 22. Since, in the two-cycle, the intake air is induced in the crankcase 2 and compressed before being transferred to the combustion chamber 7, the quantity of intake air is affect by the temperature of the crankcase. In order to determine a correcting coefficient corresponding to the actual density of the air supplied to the combustion chamber 7, the crankcase temperature TmC is necessary as a parameter as well as the atmospheric pressure Po relative to the altitude and intake air temperature TmA.

When the voltage of the battery 36 decreases, the effective injection pulse width actually provided by the injector 14 reduces. In order to correct the reduction of the pulse width, an injector voltage correcting section 54 is provided in the ECU 26. The injector voltage correcting section 54 has a look-up table (not shown) storing a plurality of invalid pulse widths in accordance with the terminal voltage VB of the battery 36. The invalid pulse width is a period of time within which fuel is not injected although the voltage VB is applied to the injector. An injector voltage correcting width Ts corresponding to the invalid pulse width retrieved from the table is provided in the section 54.

The basic fuel injection pulse width Tp, miscellaneous correction coefficient COEF and the injector voltage correcting width Ts are applied to a fuel injection pulse width calculator 55 where the actual injection pulse width Ti si calculated as follows:

$$Ti = TP \times COEF + Ts$$

The pulse width Ti is applied to the injector 14 through a driver 56 at a predetermined timing.

Figure 5:
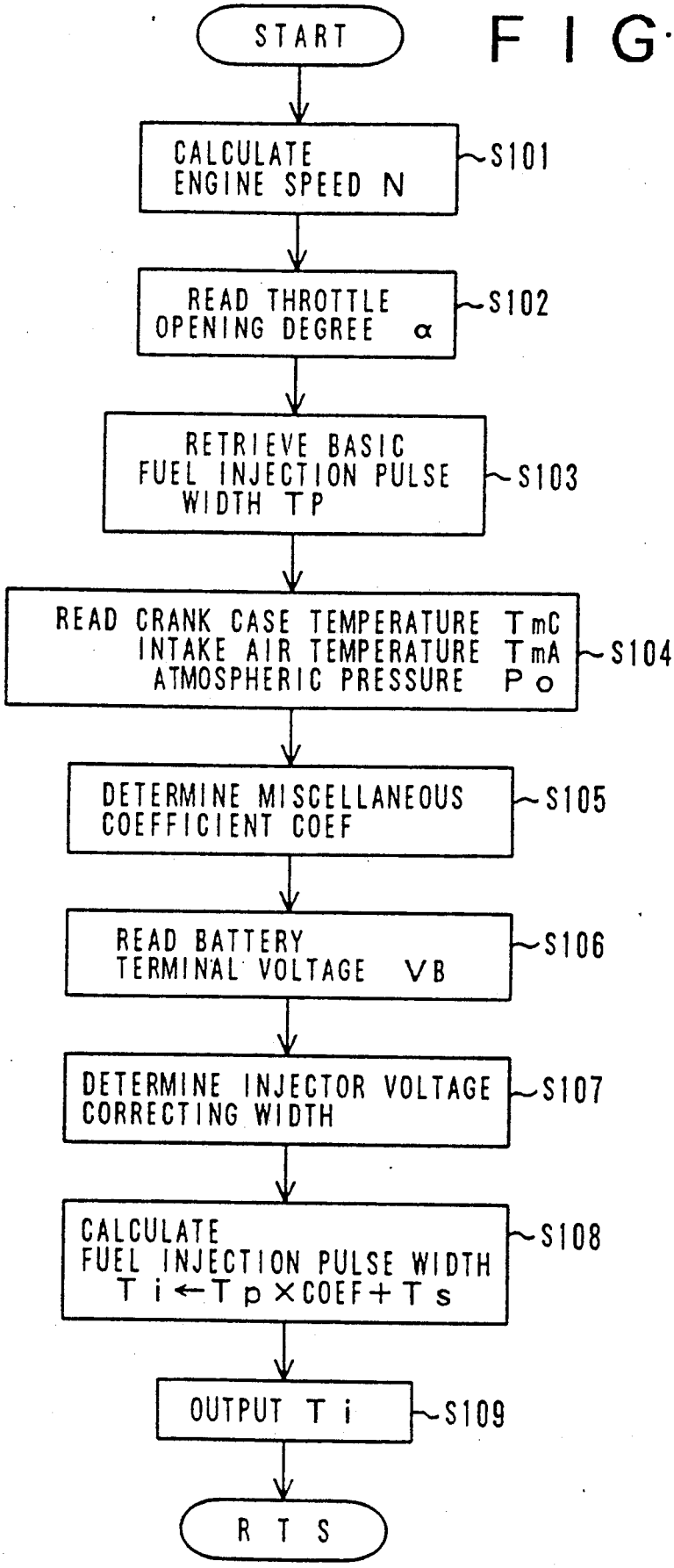
FIG. 5 is a flowchart showing the operation of the present invention.

The operation of the system of the present invention is described hereinafter with reference to FIG. 5. The program is repeated at a predetermined crank timing.

At a step S101, the cycle f is calculated in dependency on the interval between the input of the CDI pulses ($f = dt120°/d\theta 120°$) and the engine speed N is calculated based on the calculated cycle f ($N = 60/2\pi \cdot f$). At a step S102, the throttle opening degree $\alpha$ is read from the throttle position sensor 21.

At a step S103, the basic fuel injection pulse width Tp is retrieved from the basic fuel injection pulse width look-up table MPTP in accordance with the engine speed N calculated at the step S101 and the throttle opening degree $\alpha$ read at the step S102. The basic fuel injection pulse width TP may be obtained by interpolation in dependency on the injection pulse widths retrieved from the table MPTP. The crankcase temperature TmC from the crankcase temperature sensor 20, intake air temperature TmA from the intake air temperature sensor 22 and the atmospheric pressure Po from the atmospheric pressure sensor 41 are read at a step S104. The miscellaneous correction coefficient COEF is obtained in dependency on the above-described parameters at a step S105. The battery terminal voltage VB is read at a step S106, and the injector voltage correcting width Ts is obtained dependent on the terminal voltage VB at a step S107. The fuel injection pulse width Ti is calculated at a step S108 in dependency on the basic fuel injection pulse width Tp, miscellaneous ratio correction coefficient COEF and the injector voltage correcting width Ts obtained at the steps S103, S105 and S107, respectively. The driving signal corresponding to the calculated pulse width Ti is fed to the injector 14 at the predetermined timing at a step S109.

At the acceleration, although the throttle valve lib is rapidly opened, the engine speed N does not increase accordingly due to the friction of the drive belt **23*a* of the continuously variable transmission 23 and load exerted on the driven pulley 25. In fact, as the throttle opening degree $\alpha$ is rapidly increased, the engine speed is gradually increased, thus passing through the lattices B in the zone A as shown by a rapid acceleration line LACC in FIG. 4**. The quantity of fuel to be injected is increased due to the increased basic fuel injection pulse width Tp in the lattices B so that the engine speed is sufficiently increased when the engine speed reaches the clutch engaging speed line CL, thereby raising the engine power to enable the transmission of power.

To the contrary, when the throttle valve **11*b*** is rapidly closed at a high engine speed and at a high engine load, the engine speed quickly decreases, maintaining a high speed for a while as shown by a rapid deceleration line LDEC.

At the rapid acceleration at the start of the vehicle, after the engine speed N becomes higher than the clutch engaging speed line CL, the vehicle speed increases in accordance with the increase of the engine speed N and the decrease of the transmission ratio of the transmission 23. At the rapid deceleration, engine speed N decreases with the decrease of the engine output and the increase of transmission ratio along the rapid deceleration line LDEC which inevitably passes the rapid deceleration zone C where the basic fuel injection pulse width is zero. Hence the fuel injected from the injector 14 is cut-off, which serves clean to the crank case 2.

In the stable engine operating condition, the basic fuel injection pulse width Tp is retrieved from one of the lattices between the rapid acceleration line LACC and the rapid deceleration line LDEC.

Although the above described embodiment is applied to the two-cycle engine, the present invention may be applied to a four-cycle engine.

From the foregoing it will be understood that the present invention provides a fuel injection control system where basic fuel injection pulse widths stored in the look-up table are increased for the acceleration. Thus, the computing process of the microcomputer of the control system is simplified, hence reducing the capacity thereof. Since the basic fuel injection pulse widths are gradually increased as the throttle opening degree and engine speed increase, the accelerating performance at the rapid start of the vehicle is improved.

While the presently preferred embodiment of the present invention has been shown and described, it is to be understood that this disclosure is for the purpose of illustration that this disclosure is for the purpose of illustration and that various changes and modifications may be made without departing from the scope of the invention as set for the in the appended claims.

What is claimed is:

1. A fuel injection control system for an engine of a motor vehicle with a continuously variable belt-drive transmission having clutch means which engages when speed of the engine is higher than a clutch engaging speed, the system comprising:

first detector means for detecting the speed of the engine;

second detector means for detecting opening degree of a throttle valve of the engine;

a memory storing a plurality of basic pulse widths for injecting fuel, which are arranged in accordance with the engine speed and the throttle valve opening degree, some of said basic pulse widths in a speed range lower than said clutch engaging engine speed being increased for acceleration of the engine;

retrieving means for retrieving one of said basic pulse widths in accordance with the detected engine speed and the throttle valve opening degree;

calculator means for calculating a fuel injection pulse width based on the retrieved basic pulse width.

2. The fuel injection control system according to claim 1, wherein said increased basic pulse widths are provided to increase as the engine speed and the throttle opening degree increase.

* * * * *